US011350735B2

(12) United States Patent
Leng

(10) Patent No.: US 11,350,735 B2
(45) Date of Patent: Jun. 7, 2022

(54) FOLDING STOOL OR FOLDING TABLE

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 175 days.

(21) Appl. No.: 16/965,890

(22) PCT Filed: Jan. 24, 2019

(86) PCT No.: PCT/CN2019/073004
§ 371 (c)(1),
(2) Date: Jan. 4, 2021

(87) PCT Pub. No.: WO2019/144913
PCT Pub. Date: Aug. 1, 2019

(65) Prior Publication Data

US 2021/0112967 A1 Apr. 22, 2021

(30) Foreign Application Priority Data

Jan. 29, 2018 (CN) ..... 201810084607.0

(51) Int. Cl.
*A47B 3/14* (2006.01)

(52) U.S. Cl.
CPC ..... *A47B 3/14* (2013.01); *A47B 2003/145* (2013.01)

(58) Field of Classification Search
CPC ..... A47B 3/14; A47B 2003/145
(Continued)

(56) References Cited

U.S. PATENT DOCUMENTS 2,780,506 A * 2/1957 Howe ..... A47B 3/14 108/169
3,080,193 A * 3/1963 Nimmo ..... A47B 3/14 108/162

(Continued)

FOREIGN PATENT DOCUMENTS

CN 202775114 U 3/2013
CN 103445488 A 12/2013

(Continued)

OTHER PUBLICATIONS

International Search Report with English Translation, cited in PCT/CN2019/073004 dated Apr. 22, 2019, 7 pages.

(Continued)

*Primary Examiner* — Milton Nelson, Jr.
(74) *Attorney, Agent, or Firm* — Cooper Legal Group, LLC

(57) ABSTRACT

An integrated collapsible table and stool, comprising two table plates (10), two bench boards (20) and a hinging frame (30), wherein the table plates (10) are rotatably hinged to the hinging frame (30), the hinging frame (30) is movably connected to the table plates (10) and the bench boards (20) on the same side of the hinging frame (30) by a pair of supporting frames (40); the supporting frames (40) are symmetrically arranged at the front and rear ends of a fixing panel (36); the supporting frames (40) comprise vertical shafts (42), table plate supporting rods (44) connected to the upper end portions of the vertical shafts (42) and bench board supporting rods (46) connected to the lower end portions of the vertical shafts (42); the vertical shafts (42) are rotatably connected to the hinging frame (30); the bottoms of the bench board supporting rods (46) are used for support on the ground, and the tops of the bench board supporting rods (46) are connected to a cross bar (48); the cross bar (48) is rotatably and slidably connected to the bench boards (20) by a connecting member (50); the connecting member (50) is slidably connected to the bench boards (20), and the connecting member (50) is rotatably connected to the cross bar (48). The supporting frames (40) may stably support and connect the bench boards (20). In an opened state, two cross bars (48) at the bottom of the bench boards (20) are switched from the transverse direction to the longitudinal direction so as to support the bench boards (20) together and to make the bench boards (20) stable to use.

17 Claims, 9 Drawing Sheets

(58) Field of Classification Search
USPC ..... 297/158.4
See application file for complete search history.

(56) References Cited

U.S. PATENT DOCUMENTS

| | | | | | |
|---|---|---|---|---|---|
| 3,174,796 | A * | 3/1965 | Brown | A47B 3/14 | 297/158.4 |
| 3,885,829 | A * | 5/1975 | Haeger | A47B 3/14 | 108/38 |
| 4,249,773 | A * | 2/1981 | Giambalvo | A47B 3/14 | 108/174 |
| 4,826,244 | A | 5/1989 | Choi | | |
| 4,883,314 | A * | 11/1989 | Sakong | A47B 3/14 | 248/188.5 |

FOREIGN PATENT DOCUMENTS

| | | | |
|---|---|---|---|
| CN | 103829570 | A | 6/2014 |
| CN | 204132700 | U | 2/2015 |
| CN | 205030718 | U | 2/2016 |
| CN | 108294462 | A | 7/2018 |
| FR | 2664140 | A1 * | 1/1992 |

OTHER PUBLICATIONS

Written Opinion with English Translation cited in PCT/CN2019/073004 dated Apr. 22, 2019, 8 pages.

* cited by examiner

FOLDING STOOL OR FOLDING TABLE

FIELD OF THE DISCLOSURE

The present disclosure relates to an integrated folding table and bench, and in particular relates to a folding mechanism of a table and bench.

BACKGROUND OF THE DISCLOSURE

An integrated folding table and bench comprises a table board and a bench board hinged together through a bracket. By controlling the bracket, the table board and the bench board can be opened at the same time, or the table board and the bench board can be folded at the same time. The integrated folding table and bench combine the table board and the bench board for use and have the advantages of being convenient to use and an occupying a small storage space.

The existing integrated folding table and bench has a simple structure. The bench board is usually connected to the bracket by rotation, and then the bracket is hinged with a support rod. When the bench board is opened, the support rod and the bracket jointly support the bench board, when the support rod rotates to be retracted, the bench board can be folded relative to the support rod by rotating. With this structure, although the support rod and the bracket can cooperate to support the bench board, the bench board is not stable in the open state. If the weight of the human body is too heavy or the human body moves, the supporting point of the support rod and the bench board slides easily, the lighter the bench board shakes, and the support rod is seriously misaligned and loses support for the bench board.

Therefore, the structure of the existing integrated folding table and bench is not stable.

BRIEF SUMMARY OF THE DISCLOSURE

The present disclosure provides an integrated folding table and bench with a stable structure.

In order to solve the technical problems of the present disclosure, a technical solution of the present disclosure is as follows.

An integrated folding table and bench comprises two table boards being bilaterally symmetrical, two bench boards being bilaterally symmetrical, and a pivot bracket. The two table boards and the two bench boards are respectively symmetrically arranged on a left side and a right side of the pivot bracket, the two table boards are rotatably connected to the pivot bracket, the pivot bracket, a table board of the two table boards, and a bench board of the two bench boards on a same side of the pivot bracket are movably connected together by a pair of support brackets, the pair of support brackets are symmetrically disposed on a front end and a rear end of the pivot bracket, support brackets of the pair of support brackets comprise vertical shafts, table board support rods connected to upper ends of the vertical shafts, and bench board support rods connected to lower ends of the vertical shafts, the vertical shafts are rotatably connected to the pivot bracket, bottom portions of the bench board support rods are configured to be supported on ground, top portions of the bench board support rods are connected to cross bars, the cross bars are rotatably and slidably connected to the bench board by connecting members. When in a folded state, the support brackets rotate to be folded, the table board support rods give way to the table board to enable the table board to rotate downward to be folded, the connecting members slide to a middle portion of the bench board, the cross bars disposed on a bottom of the bench board rotate substantially to a lateral direction, and the bench board rotates downward to be folded about the cross bars functioning as a rotation axis. When in an open state, the table board and the bench board are lifted up to be disposed horizontal, the support brackets rotate to be opened to enable the table board support rods to support a lower side of the table board, the connecting members slide to ends of the bench board, and the cross bars disposed on the bottom portion of the bench board rotate substantially to a longitudinal direction to cooperate to support the bench board.

Compared with the background art, this technical solution has the following advantages:

1. The table board and the bench board are both movably connected to the pivot bracket by the support brackets, the cross bars are rotatably and slidably connected to the bench board by the connecting members, the connecting members are slidably connected to the bench board, the connecting members are rotatably connected to the cross bars, and the support brackets can stably support and connect the bench board, especially in the open state. The two cross bars disposed on the bottom of the bench board rotate from a horizontal direction to a longitudinal direction and cooperate to support the bench board to enable a use of the bench board to be stable.

2. The connecting member comprises the sliding seats and the rotating plates. The sliding seats are configured to achieve a sliding connection between the cross bars and the bench board, and the rotating plates are configured to achieve a rotating connection between the cross bars and the bench board. The structure is simple and effectively prevents jamming during a folding and unfolding process.

3. The ends of the table board support rods are disposed in the snapping grooves, which can improve a stability of the table board in the open state.

4. The positioning members comprise the buckle slots. After the support brackets rotate to be opened, the edges of the sliding seats are embedded in the buckle slots, which can improve a stability of the bench board in the open state.

5. The arc-shaped groove disposed on the side of the fixed panel cooperates with the arc-shaped protrusion on the side of the table board, so that after the table board is opened, there is no deep or wide gap between the table board and the fixed panel, which can prevent fingers of children from being accidentally stuck in the gap and improve a safety performance when in use.

BRIEF DESCRIPTION OF THE DRAWING

The present disclosure will be further described below with the combination with the accompanying drawings and the embodiments.

DETAILED DESCRIPTION OF THE EMBODIMENTS

Embodiment 1

Figure 1:
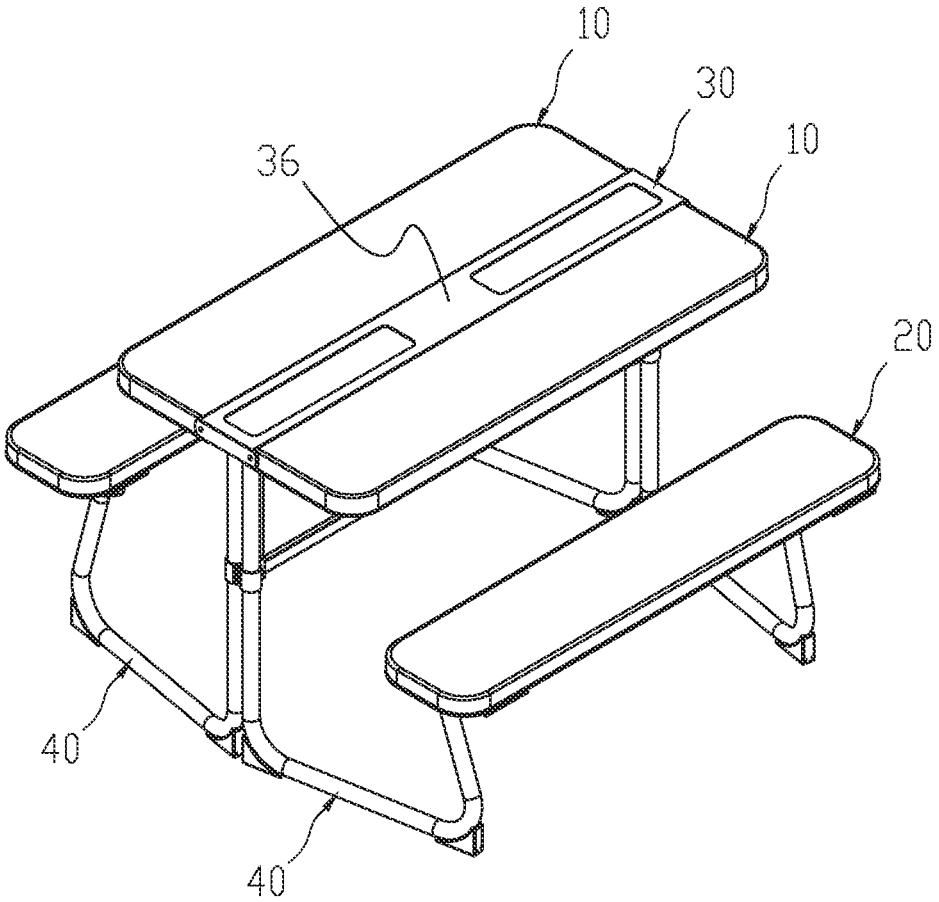
FIG. 1 illustrates a perspective view of an integrated folding table and bench of Embodiment 1 of the present disclosure in an open state.
Figure 2:
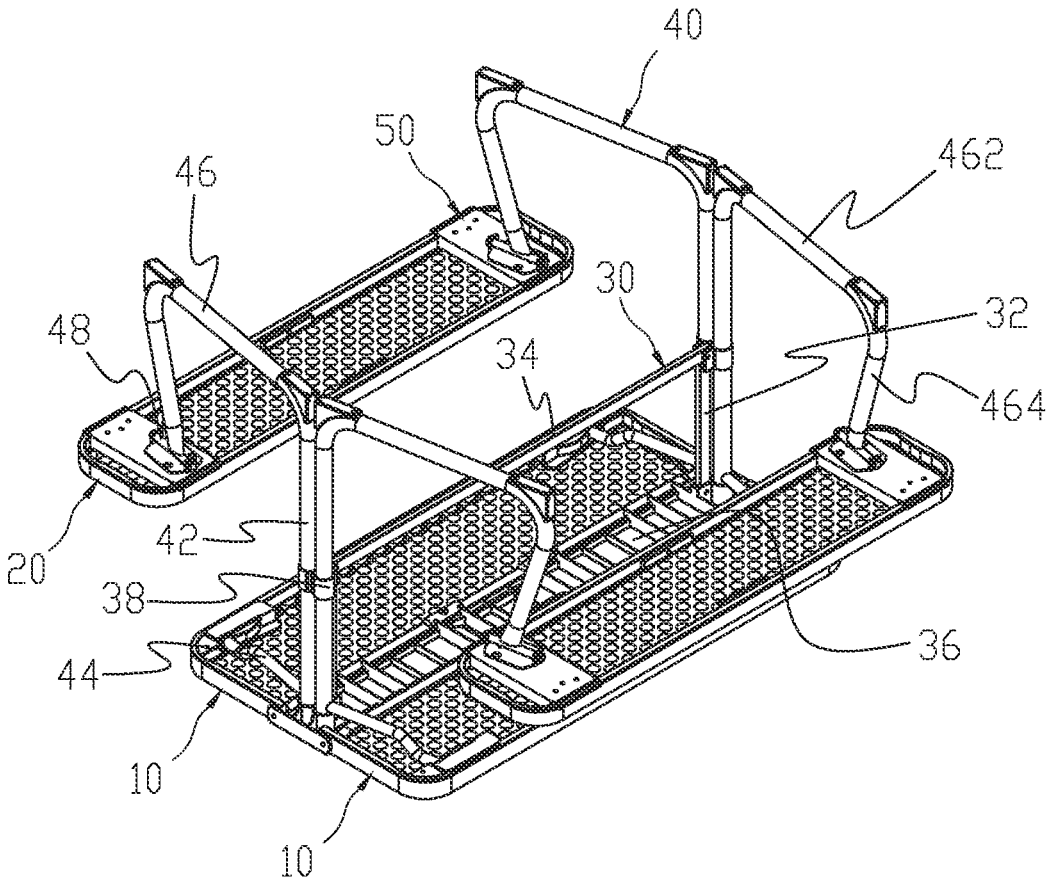
FIG. 2 illustrates another perspective view of the integrated folding table and bench of Embodiment 1 of the present disclosure in the open state.
Figure 3:
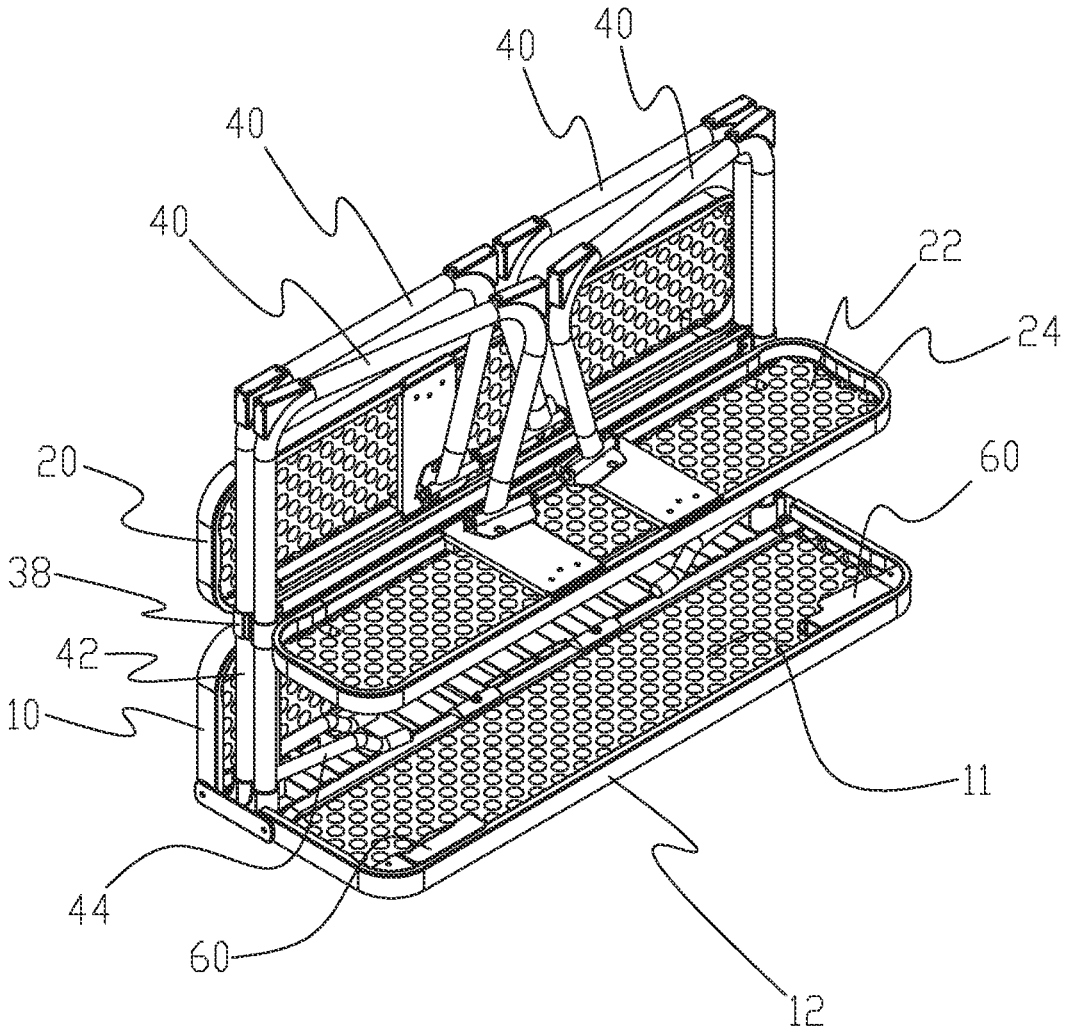
FIG. 3 illustrates a perspective view of the integrated folding table and bench of Embodiment 1 of the present disclosure when support brackets of the integrated folding table and bench are folded.
Figure 4:
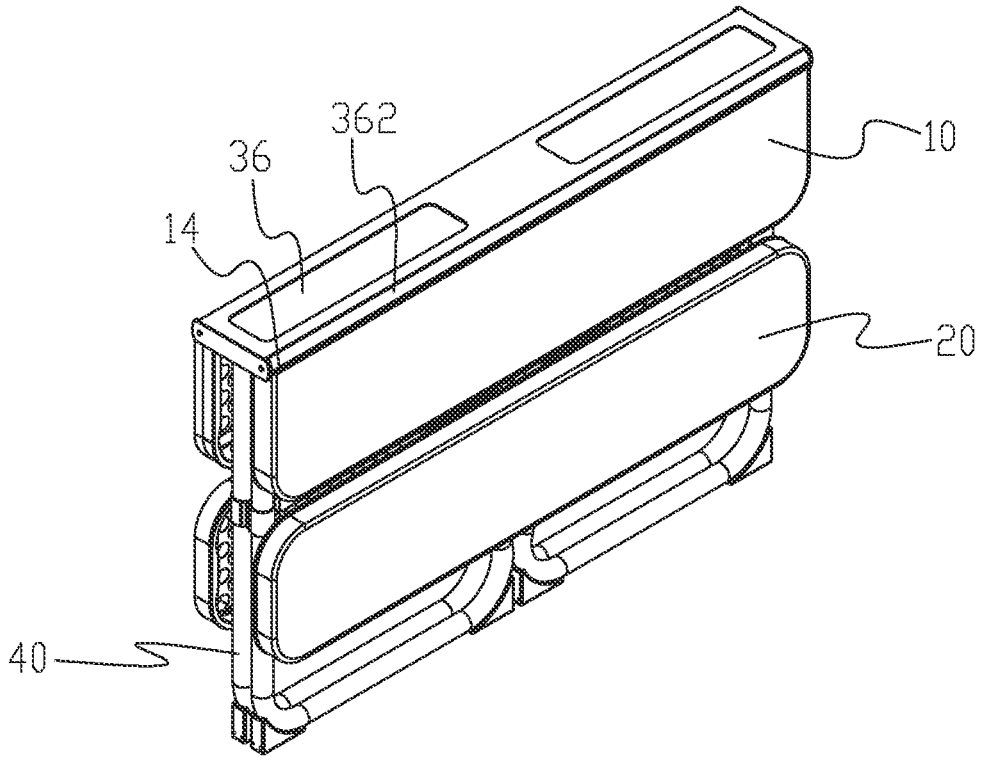
FIG. 4 illustrates a perspective view of the integrated folding table and bench of Embodiment 1 of the present disclosure in a folded state.
Figure 5:
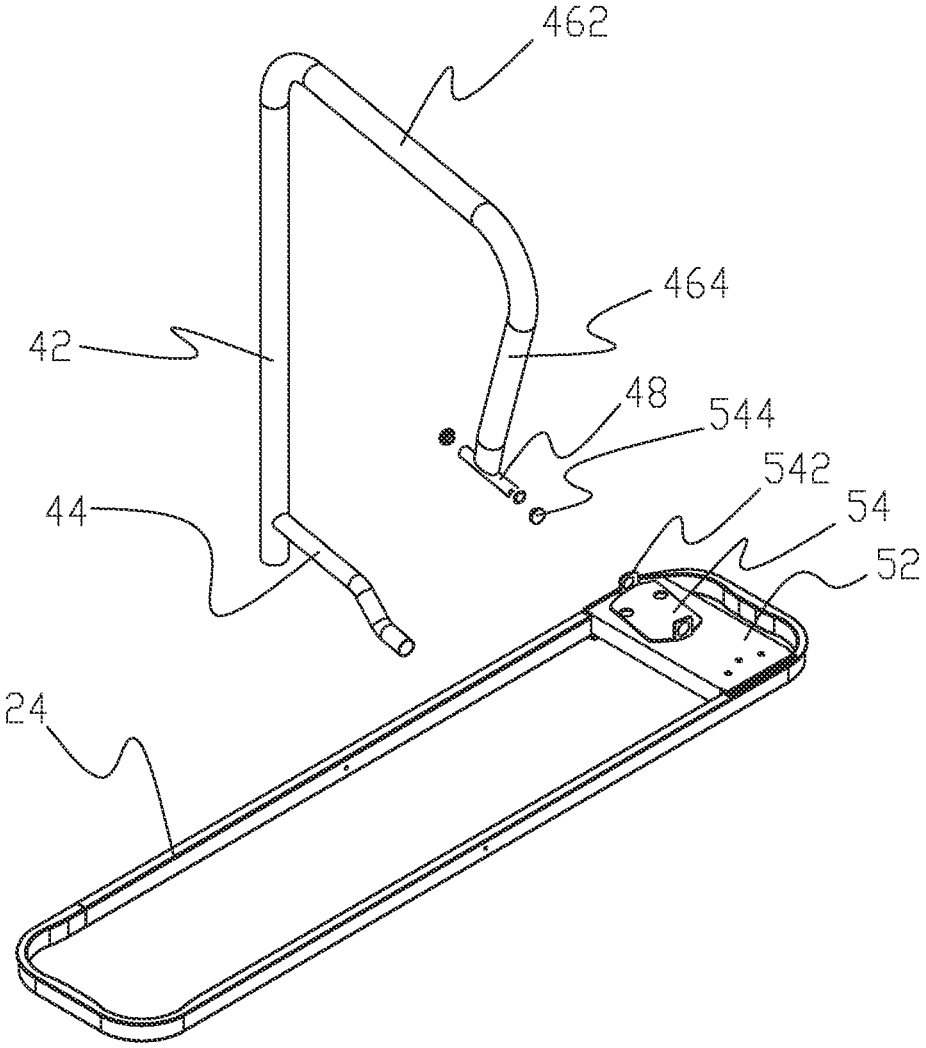
FIG. 5 illustrates an exploded view of a support bracket and a connector of the integrated folding table and bench of Embodiment 1 of the present disclosure.
Figure 6:
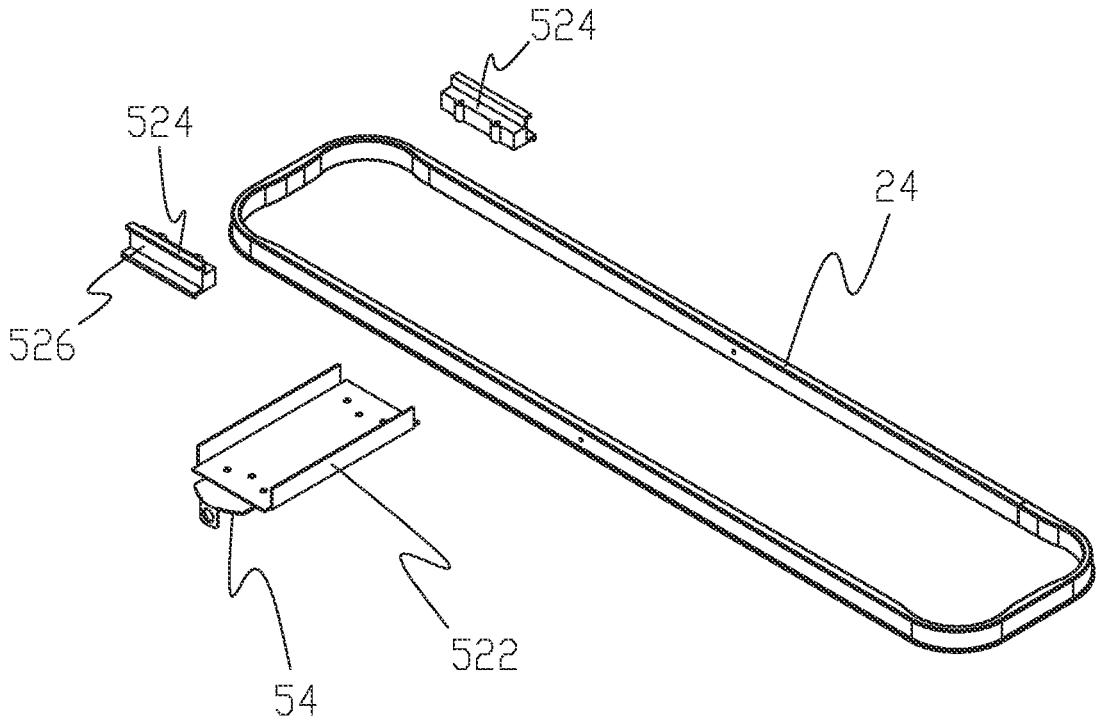
FIG. 6 illustrates an exploded view of a sliding base and a frame of the integrated folding table and bench of Embodiment 1 of the present disclosure.

Referring to FIGS. 1-6, an integrated folding table and bench of the present disclosure comprises two table boards 10, two bench boards 20, and a pivot bracket 30. The two table boards 10 and two bench boards 20 are both respectively and symmetrically disposed on a left side and a right side of the pivot bracket 30, and the table boards 10 are rotatably connected to the pivot bracket 30. The pivot bracket 30 is movably connected to a table board 10 and a bench board 20 disposed on the same side by a pair of support brackets 40. Therefore, there are four support brackets 40 divided into two pairs. A first pair of support brackets 40 disposed on a left side and a second pair of support brackets 40 disposed on a right side of the pivot bracket 30 are both symmetrically disposed on a front end and a rear end of the pivot bracket 30. The support brackets 40 comprise vertical shafts 42, table board support rods 44 connected to upper ends of the vertical shafts 42, and bench board support rods 46 connected to lower ends of the vertical shafts 32. The vertical shafts 42 are rotatably connected to the pivot bracket 30. Bottom portions of the bench board support rods 46 are supported on the ground, and top ends of the bench board support rods 46 are connected to cross bars 48. The cross bars 48 are rotatably and slidably connected to the bench boards 20 through connecting members 50.

In a folded state, the support brackets 40 rotate and are folded to a lower side of a fixed panel of the pivot bracket 30, and the table board support rods 44 move away from a lower side of the table boards 10 to give way to the table boards 10 to enable the table boards 10 to be configured to rotate downward to be folded. At the same time, the bench board support rods 46 drive the connecting members 50 to slide to middle portions of the bench boards 20, the cross bars 48 (two cross bars of each of the pairs of support brackets 40) disposed on a bottom portion of the bench boards 20 rotate substantially to a lateral direction, and the bench boards 20 rotate downward and be folded about the cross bars 48 functioning as rotating axes.

In an open state, the table boards 10 and the bench boards 20 are lifted up to be disposed horizontally, the support brackets 40 rotate to be opened to enable the table board support rods 44 to support the lower side of the table boards 10, and the table board support rods 44 of the support brackets 40 cooperate to support the table boards 10. At the same time, the bench board support rods 46 drive the connecting members 50 to slide to ends of the bench boards 20, and the cross bars 48 (two cross bars of each of the pairs of support brackets 40) disposed on the bottom portion of the bench boards 20 substantially rotate to a longitudinal direction to cooperate to support the bench boards 20.

The pivot bracket 30 comprises two vertical rods 32 symmetrically disposed in parallel, a connecting rod 34 connected to bottom portions of the two vertical rods 32, and a fixed member 36 connected to top portions of the two vertical rods 32. The table boards 10 are rotatably connected to the fixed member 36. The bottom portions of the two vertical rods 32 are disposed with rod sleeves 38 configured to encompass the vertical shafts 42 of the support brackets 40.

The fixed member 36 can be a fixed panel and is a central portion of a panel. The two table boards 10 are opened to be substantially on the same plane with the fixed member 36. Sides of the fixed member 36 opposite to the table boards 10 comprise arc-shaped grooves 362, and sides of the table boards 10 opposite to the fixed member 36 comprise arc-shaped protrusions 14. In the open state, the arc-shaped protrusions 14 are configured to be embedded in the arc-shaped grooves 362. Ends of the vertical shafts 42 are disposed in the fixed member 36, and the two are rotatably connected.

The connecting members 50 comprise sliding seats 52 and rotating plates 54. The sliding seats 52 are configured to slide along a length direction of the bench boards 20, and the rotating plates 54 are rotatably connected to bottom surfaces of the sliding seats 52. The cross bars 48 are rotatably pivoted to the rotating plates 54. Two sides of the rotating plates 54 comprise lugs 542. The lugs 542 comprise through holes, and plugs 544 are disposed in the through holes. The cross bars 48 are clamped by the plugs 544 disposed in the though holes.

The bench boards 20 each comprise a seat board 22 and a frame 24. The frame 24 is disposed along a periphery of a bottom portion of the seat board 22, and the sliding seats 52 are slidably connected to the frame 24. The sliding seats 52 each comprise a body 522 and two fasteners 524, and the two fasteners 524 are respectively disposed on left and right sides of the body 522. The fasteners 524 comprise fastening grooves 526 with side openings, and the fastening grooves 526 are fastened to the frame 24.

The table boards 10 each comprise a table top 11 and a table frame 12, and the table frame 12 is disposed along a periphery of a bottom portion of the table top 11. The table frame 12 is disposed with limiting members 60 corresponding to the table board support rods 44. The limiting members 60 are disposed under the table top 11, and the limiting members 60 comprise snapping grooves. After the support brackets 40 rotate to be opened, ends of the table board support rods 44 are disposed in the snapping grooves. Ends of the limiting members 60 are rotatably connected to the table frame 12, and springs are disposed between the limiting members 60 and the table frame 12. The limiting members 60 are pressed to overcome elastic force of the springs, so that the ends of the table board support rods 44 are separated from the snapping grooves.

In some embodiments, the rotating plates 54 are disposed on bottom surfaces of the sliding seats 52 at positions adjacent to the fixed member 36, so that the bench boards 20 are configured to be folded downward naturally. The bench board support rods 46 comprise 7-shaped structures and comprise horizontal sections 462 and bending sections 464. The horizontal sections 462 are configured to be stably supported on the ground, and ends of the bending sections 464 are connected to the cross bars 48.

Embodiment 2

Figure 7:
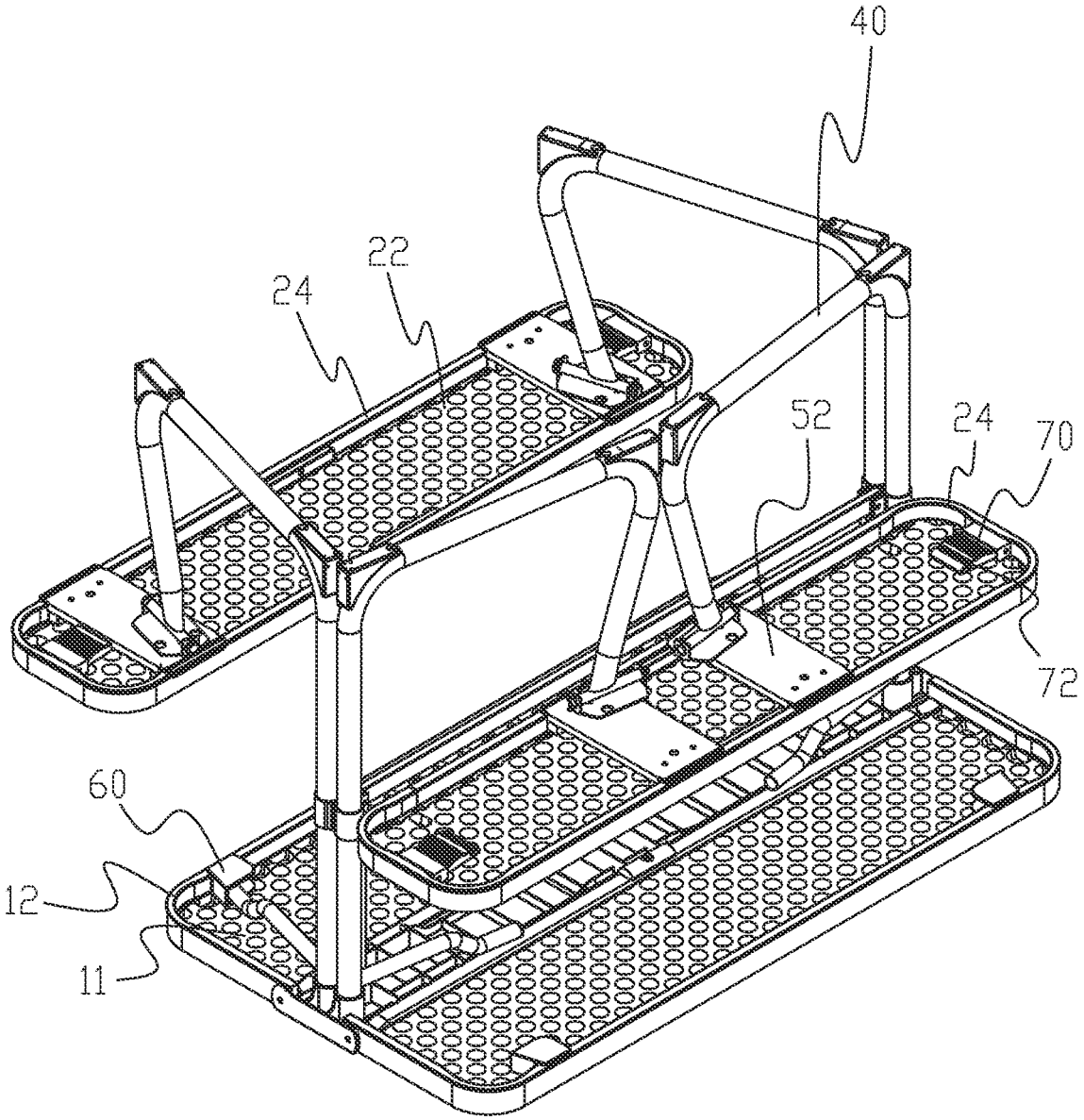
FIG. 7 illustrates a perspective view of an integrated folding table and bench of Embodiment 2 of the present disclosure.

Referring to FIG. 7, Embodiment 2 differs from Embodiment 1 in that the limiting members 60 are U-shaped structures and are directly secured to the table frame 12 to prevent from rotation. Further, the frames 24 of the bench boards 20 comprises positioning members 70, the positioning members 70 are disposed under the seat board 22, and the positioning members 70 comprise buckle slots 72. After the support brackets 40 rotate to be opened, edges of the sliding seats 52 are snapped in the buckle slots 72. First ends of the positioning members 70 are rotatably connected to the frames 24, and springs are disposed between the positioning members 70 and the seat board 22. Second ends of the positioning members 70 are pressed to overcome elastic force of the springs, so that the first ends of the positioning members 70 are separated from the edges of the sliding seats 52.

Embodiment 3

Figure 8:
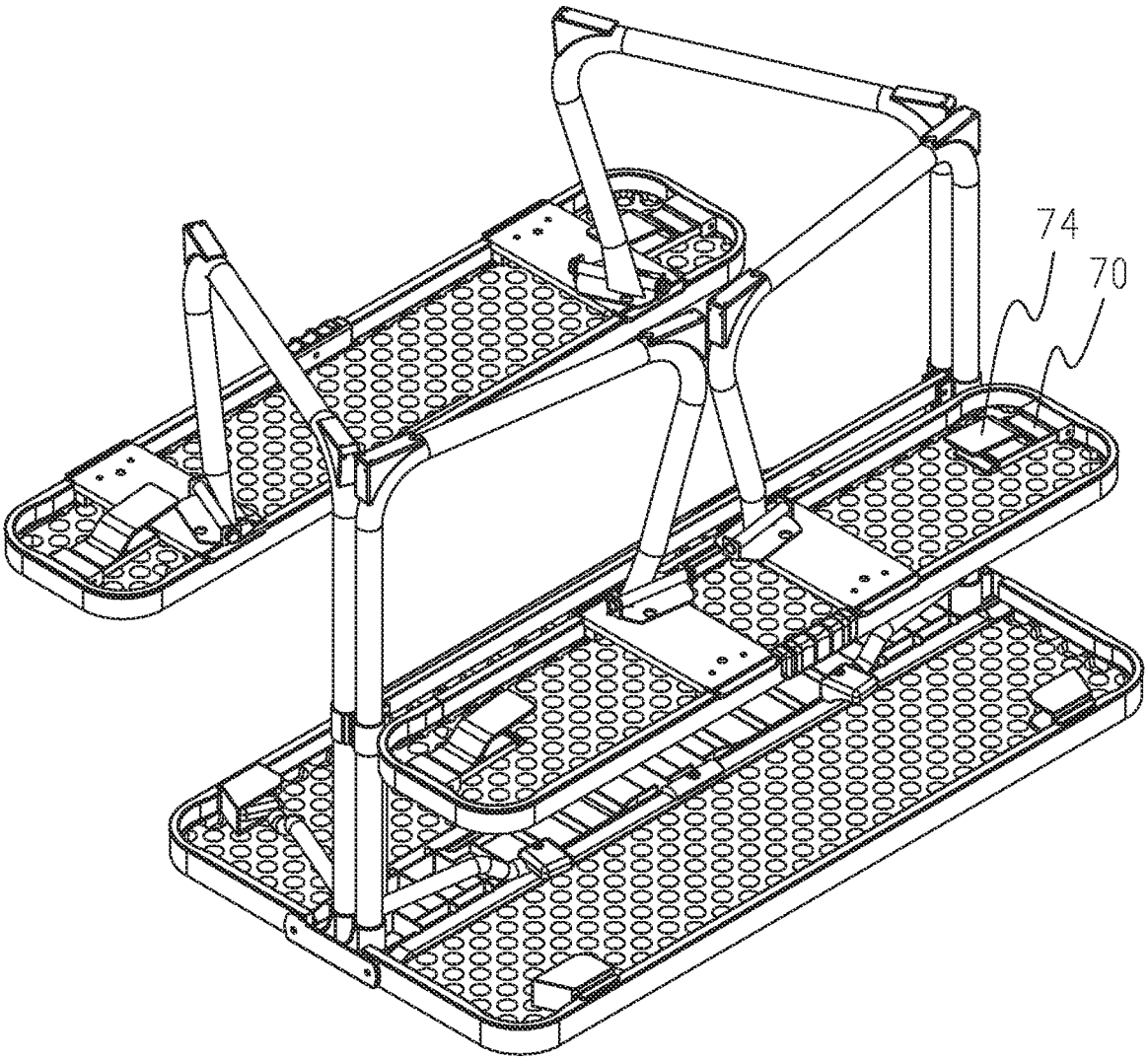
FIG. 8 illustrates a perspective view of an integrated folding table and bench of Embodiment 3 of the present disclosure.

Referring to FIG. 8, Embodiment 3 differs from Embodiment 2 in that the positioning members 70 are disposed with pressing tongue pieces 74. The pressing tongue pieces 74 can facilitate the positioning members 70 to be pressed, and restrictions for the sliding seats 52 are released.

Embodiment 4

Figure 9:
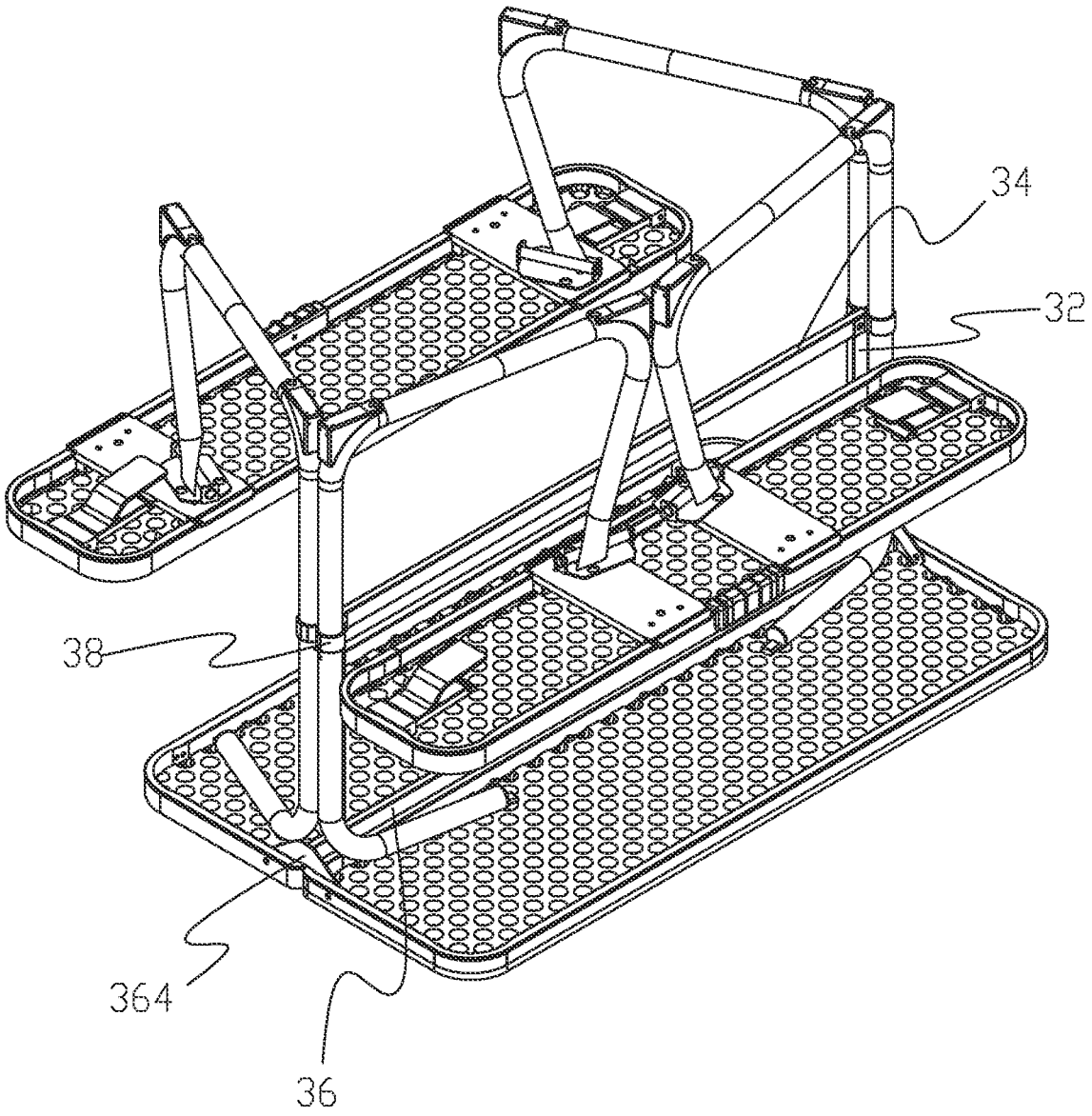
FIG. 9 illustrates a perspective view of an integrated folding table and bench of Embodiment 4 of the present disclosure.

Referring to FIG. 9, Embodiment 4 differs from Embodiment 3 in that the fixed member 36 has a long rod structure, ends of the fixed member 36 are disposed with connecting pieces 364, and the table boards 10 are pivotally connected to the connecting pieces 364. The fixed member 36, the connecting rod 34, and the two vertical rods 32 define a rectangular frame. When the two table boards 10 are opened, the fixed member 36 is disposed under the table boards 10.

Therefore, it is understandable that the fixed member 36 can be the long rod structure or can be a plate structure, as long as the fixed member 36 can be pivotally connected to the table boards 10 to enable the table boards 10 to be flipped.

The aforementioned embodiments are merely some embodiments of the present disclosure, and the scope of the disclosure of is not limited thereto. Thus, it is intended that the present disclosure cover any modifications and variations of the presently presented embodiments provided they are made without departing from the appended claims and the specification of the present disclosure.

INDUSTRIAL APPLICABITY

Compared with the background art, this technical solution has the following advantages: a use of the bench board is stable, which is effectively prevents jamming during a folding and unfolding process, improves a stability of the table board in the open state, and improve a stability of the bench board in the open state. After the table board is opened, there is no deep or wide gap between the table board and the fixed panel, which can prevent fingers of children from being accidentally stuck in the gap and improve a safety performance when in use. It has a good industrial applicability.

What is claimed is:

1. An integrated folding table and bench, comprising:

two table boards being bilaterally symmetrical, two bench boards being bilaterally symmetrical, and a pivot bracket, wherein:

the two table boards and the two bench boards are respectively symmetrically arranged on a left side and a right side of the pivot bracket, the two table boards are rotatably connected to the pivot bracket, the pivot bracket, a table board of the two table boards, and a bench board of the two bench boards on a same side of the pivot bracket are movably connected together by a pair of support brackets, the pair of support brackets are symmetrically disposed on a front end and a rear end of the pivot bracket, support brackets of the pair of support brackets comprise vertical shafts, table board support rods connected to upper ends of the vertical shafts, and bench board support rods connected to lower ends of the vertical shafts, the vertical shafts are rotatably connected to the pivot bracket, bottom portions of the bench board support rods are configured to be supported on ground, top portions of the bench board support rods are connected to cross bars, the cross bars are rotatably and slidably connected to the bench board by connecting members, when in a folded state, the support brackets rotate to be folded, the table board support rods give way to the table board to enable the table board to rotate downward to be folded, the connecting members slide to a middle portion of the bench board, the cross bars are disposed on a bottom of the bench board and rotate substantially to a lateral direction, and the bench board rotates downward to be folded about the cross bars functioning as a rotation axis, when in an open state, the table board and the bench board are lifted up to be disposed horizontal, the support brackets rotate to be opened to enable the table board support rods to support a lower side of the table board, the connecting members slide to ends of the bench board, and the cross bars disposed on the bottom portion of the bench board rotate substantially to a longitudinal direction to cooperate to support the bench board.

2. The integrated folding table and bench according to claim 1, wherein:

the pivot bracket comprises two vertical rods symmetrically disposed in parallel, a connecting rod connected to bottom portions of the two vertical rods, and a fixed member connected to top portions of the two vertical rods, and the table board is rotatably connected to the fixed member.

3. The integrated folding table and bench according to claim 2, wherein:

the fixed member comprises a rod structure, and ends of the fixed member are disposed with connecting pieces, and the table board is pivotally connected to the connecting pieces.

4. The integrated folding table and bench according to claim 2, wherein:

the fixed member comprises a fixed panel, the two table boards are opened to be substantially on a same plane with the fixed panel, the support brackets rotate to be folded under the fixed panel in the folded state, a side of the fixed panel opposite to the table board comprises an arc-shaped groove, a side of the table board opposite to the fixed panel comprises an arc-shaped protrusion, and the arc-shaped protrusion is configured to be embedded in the arc-shaped groove.

5. The integrated folding table and bench according to claim 4, wherein the vertical shafts are rotatably connected to the fixed panel.

6. The integrated folding table and bench according to claim 2, wherein the bottom portions of the two vertical rods are disposed with rod sleeves configured to encompass the vertical shafts of the support brackets.

7. The integrated folding table and bench according to claim 6, wherein:

the fixed member comprises a fixed panel, the two table boards are opened to be substantially on a same plane with the fixed panel, the support brackets rotate to be folded under the fixed panel in the folded state, a side of the fixed panel opposite to the table board comprises an arc-shaped groove, a side of the table board opposite to the fixed panel comprises an arc-shaped protrusion, and the arc-shaped protrusion is configured to be embedded in the arc-shaped groove.

8. The integrated folding table and bench according to claim 6, wherein:

the fixed member comprises a rod structure, and ends of the fixed member are disposed with connecting pieces, and the table board is pivotally connected to the connecting pieces.

9. The integrated folding table and bench according to claim 1, wherein:

the table board comprises a table top and a table frame, the table frame is disposed along a periphery of a bottom portion of the table top, the table frame is disposed with limiting members, the limiting members are disposed under the table top, the limiting members comprise snapping grooves, and after the support brackets rotate to be opened, ends of the table board support rods are disposed in the snapping grooves.

10. The integrated folding table and bench according to claim 9, wherein:

ends of the limiting members are rotatably connected to the table frame, springs are disposed between the limiting members and the table frame, and the limiting members are pressed downward to overcome elastic force of the springs to enable the ends of the table board support rods to be separated from the snapping grooves.

11. The integrated folding table and bench according to claim 1, wherein:

the connecting members comprise sliding seats and rotating plates, the sliding seats are configured to slide along a length direction of the bench board, the rotating plates are rotatably connected to bottom surfaces of the sliding seats, and the cross bars are rotatably connected to the rotating plates.

12. The integrated folding table and bench according to claim 11, wherein:

two sides of the rotating plates comprise lugs, the lugs comprise though holes, plugs are disposed in the through holes, and the cross bars are clamped by the plugs disposed in the through holes.

13. The integrated folding table and bench according to claim 12, wherein:

the bench board comprises a seat board and a frame, the frame is disposed along a periphery of a bottom portion of the seat board, the sliding seats are slidably connected to the frame, the sliding seats each comprise a body and two fasteners, the two fasteners are respectively disposed on a left side and a right side of the body, the two fasteners comprise fastening grooves with side openings, and the fastening grooves are snapped to the frame.

14. The integrated folding table and bench according to claim 11, wherein:

the bench board comprises a seat board and a frame, the frame is disposed along a periphery of a bottom portion of the seat board, the sliding seats are slidably connected to the frame, the sliding seats each comprise a body and two fasteners, the two fasteners are respectively disposed on a left side and a right side of the body, the two fasteners comprise fastening grooves with side openings, and the fastening grooves are snapped to the frame.

15. The integrated folding table and bench according to claim 14, wherein:

the frame of the bench board is disposed with positioning members, the positioning members are disposed under the seat board, the positioning members comprise buckle slots, and after the support brackets rotate to be opened, edges of the sliding seats are embedded in the buckle slots.

16. The integrated folding table and bench according to claim 15, wherein:

first ends of the positioning members are rotatably connected to the frame, springs are disposed between the positioning members and the seat board, and second ends of the positioning members are pressed to overcome elastic force of the springs to enable the positioning members to be separated from the edges of the sliding seats.

17. The integrated folding table and bench according to claim 16, wherein the positioning members are disposed with pressing tongue pieces.

* * * * *